US005580052A

United States Patent [19]

Popadiuk et al.

[11] Patent Number: 5,580,052

[45] Date of Patent: Dec. 3, 1996

[54] ROTATING MAGNETIC BOX PLAY FEATURE FOR A PINBALL GAME

[75] Inventors: John A. Popadiuk; John W. Skalon, both of Chicago, Ill.

[73] Assignee: Williams Electronics Games, Inc., Chicago, Ill.

[21] Appl. No.: 490,142

[22] Filed: Jun. 14, 1995

[51] Int. Cl.[6] ..... A63F 7/30

[52] U.S. Cl. ..... 273/127 R; 273/118 A; 273/119 A; 273/121 A

[58] Field of Search ..... 273/118, 119, 273/121, 127 R, 127 B, 127 C, 127 D

[56] References Cited

U.S. PATENT DOCUMENTS 5,351,954 10/1994 Oursler et al. .
5,358,242 10/1994 Trudeau et al. ..... 273/119 AX
5,375,829 12/1994 Lawlor et al. .
5,415,402 5/1995 Morrison et al. ..... 273/121 A
5,415,403 5/1995 Ritchie et al. ..... 273/121 A
5,417,422 5/1995 Hansen ..... 273/121 A
5,452,894 9/1995 Hansen ..... 273/121 A

*Primary Examiner*—Raleigh W. Chiu
*Attorney, Agent, or Firm*—Rockey, Rifkin and Ryther

[57] ABSTRACT

The play feature of the invention comprises a planar surface which is rotatable above the playfield of a pinball game between a ball receiving and a ball discharge position. An electromagnet is attached to the planar surface. A ball detector, such as an eddy current sensor, is mounted to the playfield adjacent the housing to detect the approach of a pinball to the electromagnet. The magnet can be energized to suspend a ball from the planar surface which is then rotated to a ball discharge position where the magnet is deenergized to discharge the ball.

6 Claims, 2 Drawing Sheets

ROTATING MAGNETIC BOX PLAY FEATURE FOR A PINBALL GAME

BACKGROUND OF THE INVENTION

The invention generally relates to pinball games and, more particularly, to an improved play feature having a rotatable box including a ball magnet for use in such games.

Pinball games typically consist of an inclined play field supporting a rolling ball, player operated-flippers and a plurality of play features such as targets, ramps, bumpers, gates and the like mounted on the playfield. A typical object of pinball games is for the player to direct pinballs at selected play features or targets to score points. It is desirable for pinball game manufacturers to design play features which stimulate player interest in the game by providing visually entertaining effects and by allowing players to obtain increased scores.

SUMMARY OF THE INVENTION

The play feature of the present invention comprises a housing or box mounted for rotation about a central axis and rotatable between ball receiving and ball discharge positions. An electromagnet is attached to one wall of the housing. A ball detector, such as an eddy current sensor, is secured to the playfield immediately in front of the housing to detect the approach of a ferromagnetic pinball. When a pinball is detected, the magnet can be energized to suspend the ball on the wall. The box is then rotated to the ball discharge position, out of sight of the player, where the magnet is deenergized to discharge the ball, preferably below the playfield to make it "disappear."

DESCRIPTION OF A PREFERRED EMBODIMENT

Figure 1:
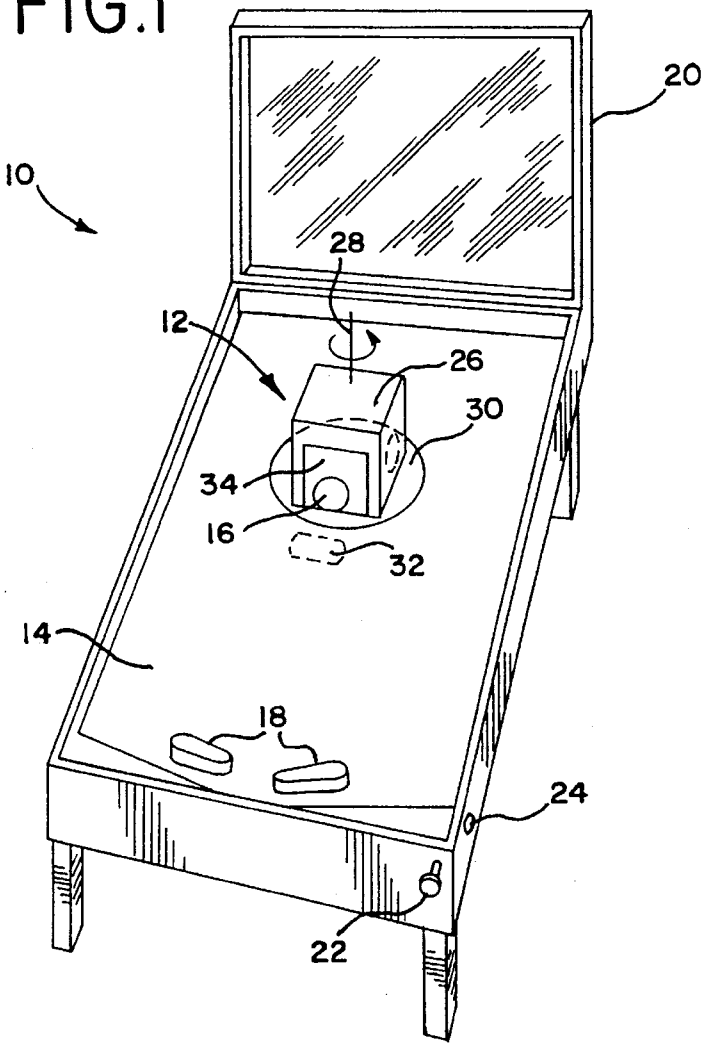
FIG. 1 is a perspective view of a pinball game incorporating the play feature of the invention.

Referring to FIG. 1, pinball game 10 includes an inclined playfield 14 for supporting a rolling ferromagnetic ball 16 which can be propelled across the playfield by a pair of player-operated flippers 18. A backbox 20 houses a game microprocessor and other electronics for controlling play of the game. A player manipulates shooter 22 to put a ball in play and presses flipper switches 24 to activate the flippers 18.

Figure 2:
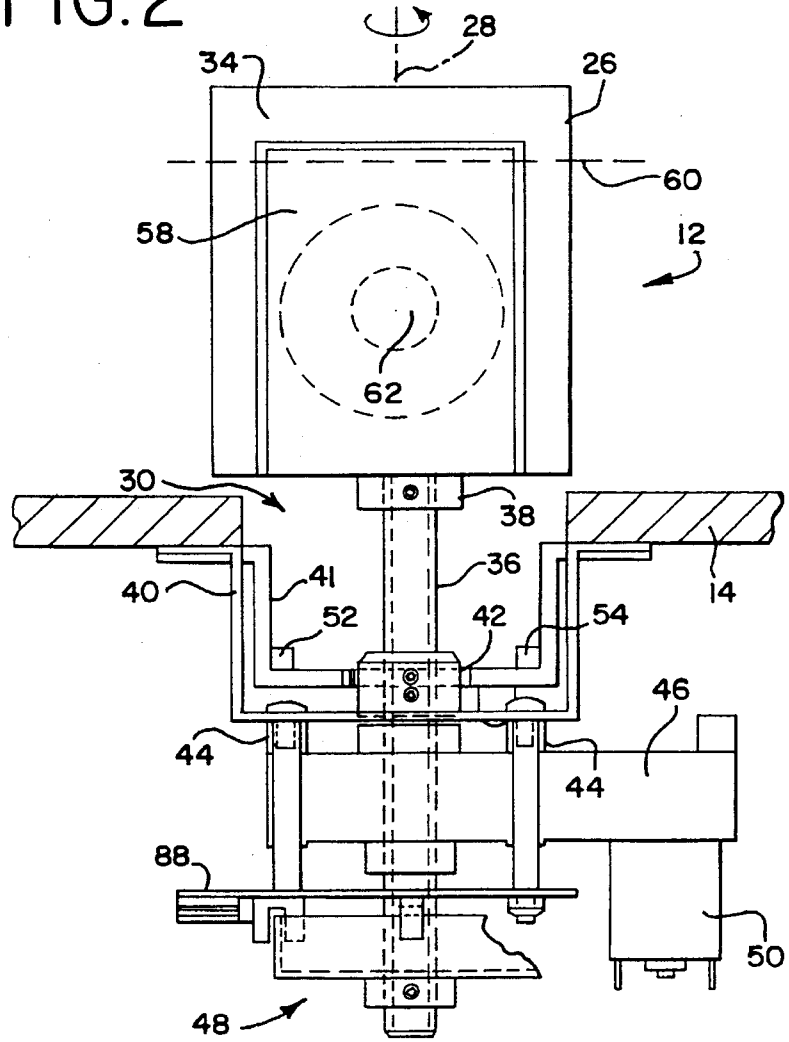
FIG. 2 is a front side view of the play feature shown in FIG. 1.

As shown in FIGS. 1 and 2, play feature 12 comprises a housing or box 26 mounted for rotation about a vertical axis 28 above playfield aperture 30. Front side 34 of box 26 includes a wall 58 which is hingedly mounted for rotation about a horizontal axis 60 at its top end. Electromagnet 62, shown in phantom, is mounted on the inside of wall 58.

Figure 3:
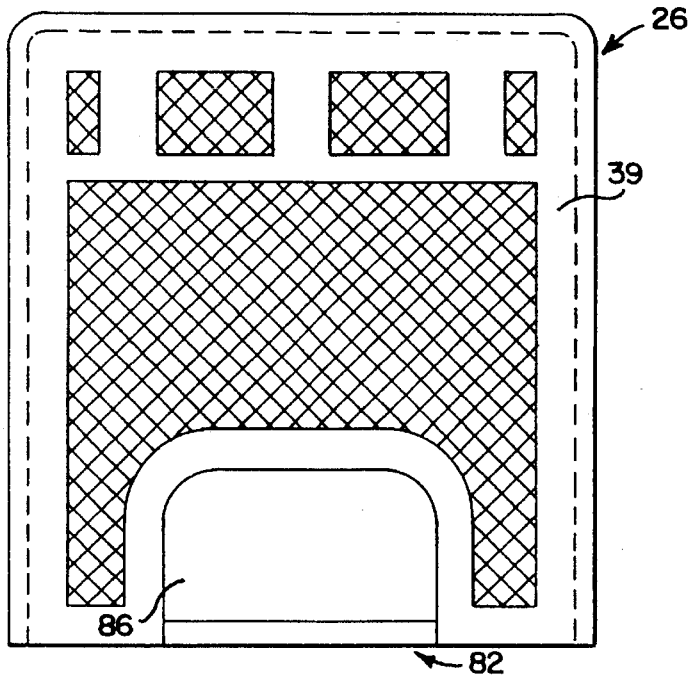
FIG. 3 is a rear side view of the play feature shown in FIG. 2.
Figure 5:
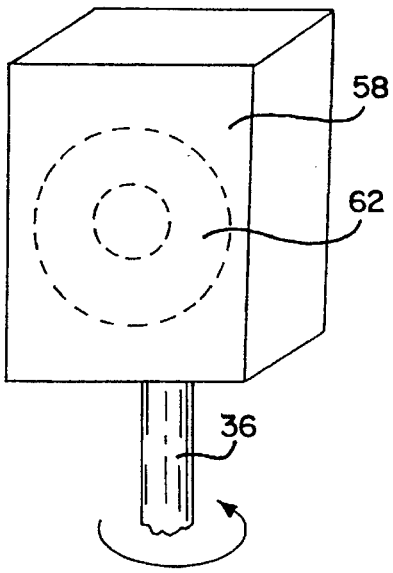
FIG. 5 is a perspective view of an alternate embodiment of the invention.

As shown in FIG. 3, the back side wall of box 26 has a ball deflector 86 disposed inside of a central opening 82 in the lower portion of its back wall 39. It will be appreciated that the play feature can be of other shapes or configurations so long as it is capable of supporting electromagnet 62 as illustrated. For example, box 26 can be rectangular or square or even a three or five sided enclosure. Alternatively, the play feature can simply be a single vertical wall of suitable thickness rotatable between the two ball positions as shown in FIG. 5. Electromagnet 62 is mounted to one face of wall 58 which is rotatable about shaft 36. This embodiment does not include a back wall opening or a ball diverter 86.

Referring to FIG. 2, the play feature 12 is mounted to the underside of playfield 14 by bracket 40 which includes a bearing 42 for supporting shaft 36. Box 26 is attached to shaft 36 by sleeve 38 to permit the rotation of shaft 36 and housing 26 about axis 28. A plurality of support posts 44 are attached to bracket 40 to support a gear reducer 46, circuit board 88 and an optical interrupter assembly 48. Motor 50 is provided to rotate housing 26 via gear reducer 46 and shaft 36. A ball trough 41 is attached to bracket 40 to receive any pinballs that are discharged from electromagnet 62. An optical switch pair 52, 54 is positioned on bracket 40 to signal the game microprocessor when a pinball is present in trough 41.

In FIG. 1, box 26 is disposed in the ball receiving position wherein electromagnet 62 faces the player. An eddy current or similar type sensor 32 is preferably mounted beneath playfield 14 and signals the game microprocessor when a pinball approaches the play feature. When sensor 32 detects a ball 16, electromagnet 62 can be energized thereby to suspend the ferromagnetic ball from wall 58. Thereafter, the box 26 can be rotated to a ball discharge position. In this position, the electromagnet 62 can be deenergized to discharge the ball onto trough 41 (FIG. 2).

Figure 4:
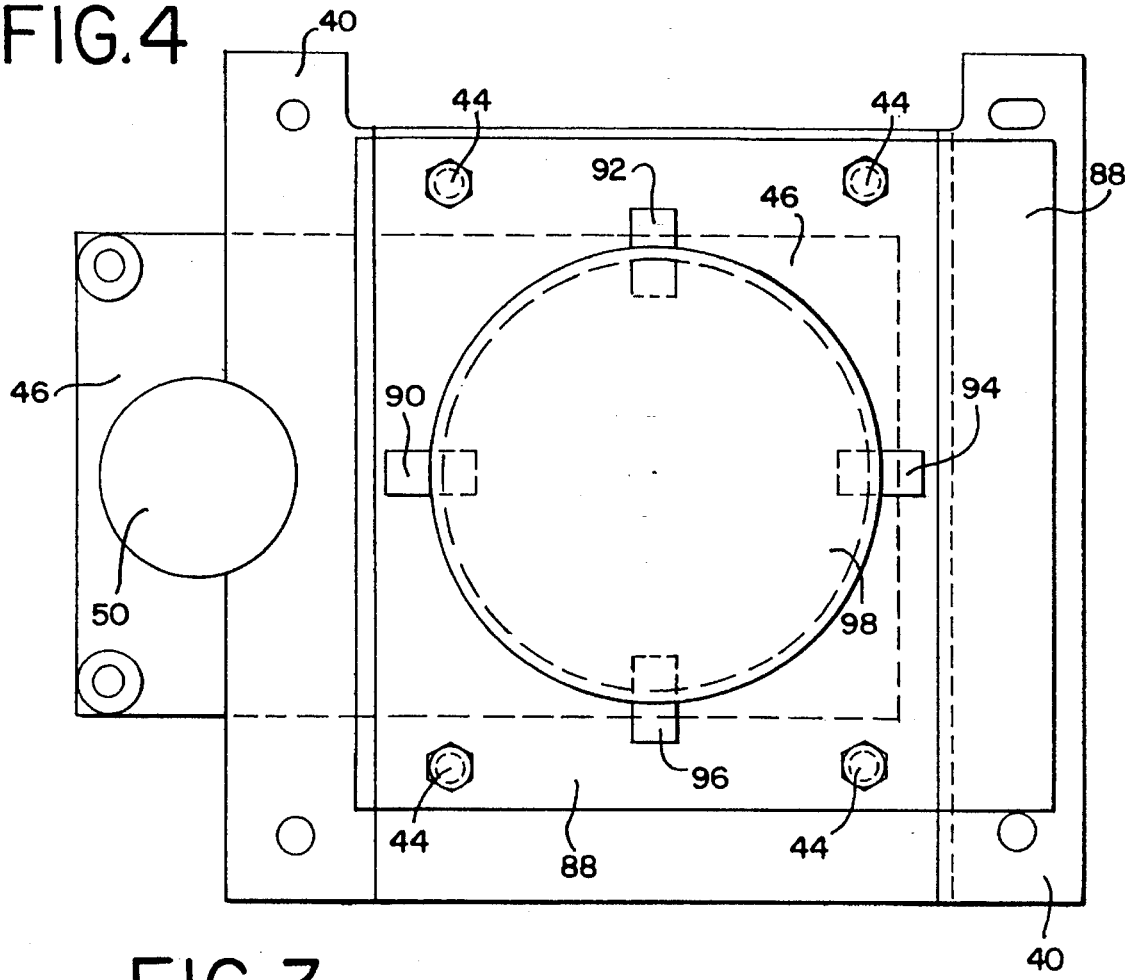
FIG. 4 is a bottom view of the play feature shown in FIG. 1.

FIG. 4 is a bottom view of play feature 12. Four optical switches 90, 92, 94 and 96 are mounted on circuit board 88. A corresponding interrupter disc 98 is mounted on shaft 36. The optical switches are selectively interrupted by a plurality of notches on disc 98 to generate signals sent to a game microprocessor which are representative of the rotational position of the play feature.

The operation of the play feature may be controlled by the game microprocessor. For example, the play feature can be selected after a player has achieved a predetermined score or when another predetermined game objective has been accomplished.

When the play feature is selected, box 26 is moved to the ball receiving position illustrated in FIG. 1 wherein front side 34 and electromagnet 62 face the player controlled flippers. A ball can be delivered to the play feature either automatically by a suitable microprocessor controlled ball delivery mechanism or, preferably, by the game player shooting the ball at it using the game flippers. When a ball is detected by eddy current sensor 32, electromagnet 62 is energized.

The impact of the ball against wall 34 involves a significant amount of kinetic energy due to the speed of the ball. The severity of the impact is lessened by the hinged connection of the wall 58 to the box 26. This is desirable to ensure that the ball does not bounce away in spite of the magnetic attraction of electromagnet 62. After the ball is suspended on wall 58, motor 50 is operated to rotate housing 26 approximately 180 degrees to a ball discharge position so that the suspended ball is no longer visible to the player.

When the ball discharge position is reached, the electromagnet is deenergized to discharge the suspended ball into trough 41 which leads to a suitable ball storage device or other feature to place the ball back in play. In the discharge position, ball deflector 86 and wall 39 face the game flippers 18 to direct any pinballs delivered to box 26 directly into trough 41. Wall 39 may remain facing the player until the player qualifies to energize the magnet to attempt to make a ball "disappear."

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. A play feature for a pinball game having a playfield and at least one ferromagnetic ball comprising:

a) a vertically disposed planar surface rotatable between ball receiving and ball discharge positions;

b) an electromagnet mounted to one face of said surface;

c) means for energizing said electromagnet to attract and suspend a ball on said surface; and d) means for rotating said surface to said ball discharge position to discharge the ball.

2. The play feature of claim 1 wherein said play feature includes a sensor for detecting the presence of a ball adjacent said surface.

3. The play feature of claim 2 wherein said sensor comprises an eddy current sensor.

4. The play feature of claim 1 wherein said planar surface is secured to a rotatable housing.

5. The play feature of claim 4 wherein said housing includes a second planar surface having an opening therein and a ball deflector disposed in said opening.

6. The play feature of claim 4 wherein said housing is a rectangular box having four sides, said planar surface being one of the sides of said box.

* * * * *